US012151871B2

(12) United States Patent
Lombard

(10) Patent No.: US 12,151,871 B2
(45) Date of Patent: Nov. 26, 2024

(54) PACKAGING SYSTEM AND CORRESPONDING METHOD FOR HANDLING A PRODUCT PREPARATION COMPONENT

(71) Applicant: Henkel AG & Co. KGaA, Duesseldorf (DE)

(72) Inventor: Antoine Lombard, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 305 days.

(21) Appl. No.: 17/481,259

(22) Filed: Sep. 21, 2021

(65) Prior Publication Data

US 2022/0002066 A1 Jan. 6, 2022

Related U.S. Application Data

(63) Continuation of application No. PCT/EP2020/055521, filed on Mar. 3, 2020.

(51) Int. Cl.
*B65D 81/32* (2006.01)
*B65D 41/04* (2006.01)
*B65D 51/28* (2006.01)

(52) U.S. Cl.
CPC ..... *B65D 81/3211* (2013.01); *B65D 41/04* (2013.01); *B65D 51/2871* (2013.01); *B65D 2251/0015* (2013.01); *B65D 2251/009* (2013.01)

(58) Field of Classification Search
CPC ..... A61J 1/202; A61J 1/2024; A61J 1/2027; A61J 1/2093; B65D 25/08; B65D 25/087;
(Continued)

(56) References Cited

U.S. PATENT DOCUMENTS

2002/0030064 A1 3/2002 Lacout
2002/0066679 A1* 6/2002 Moscovitz ..... B65D 81/3211 206/221

(Continued)

FOREIGN PATENT DOCUMENTS

DE 4121540 A1 1/1993
DE 29721872 U1 1/1998

(Continued)

OTHER PUBLICATIONS

PCT International Search Report PCT/EP2020/055521 Completion Date: May 14, 2020; dated Jun. 4, 2020 2 pages.

*Primary Examiner* — King M Chu
(74) *Attorney, Agent, or Firm* — P. Scott Smith

(57) ABSTRACT

A packaging system for a multi-component product preparation, having—a first container for storing a first product preparation component,—a second container for storing at least one second product preparation component and—a closure element sealing off the first container from the environment, having a coupling apparatus which couples the second container to the closure element and establishes a fluid connection between the first and the second containers. The closure element includes a closure cap which can be separated from the closure element along a predetermined break point to open the fluid connection between the first and the second containers, wherein the closure cap can be coupled to the second container being blocked in a direction of rotation about an axis of the closure element and has a thread mechanism of which the closure cap can be connected to the first container by a thread of the first container.

13 Claims, 7 Drawing Sheets

(58) Field of Classification Search
CPC ..... B65D 51/2807; B65D 81/3211; B65D 81/3238; B65D 81/3266
USPC ..... 206/219, 221; 215/DIG. 8
See application file for complete search history.

(56) References Cited

U.S. PATENT DOCUMENTS

| | | | | |
|---|---|---|---|---|
| 2006/0049127 | A1* | 3/2006 | Katz | B65D 81/3211 215/DIG. 8 |
| 2009/0057262 | A1 | 3/2009 | Cho | |
| 2015/0360814 | A1* | 12/2015 | Foster | A47J 31/40 206/219 |
| 2020/0385192 | A1* | 12/2020 | Marina | B65D 81/3211 |

FOREIGN PATENT DOCUMENTS

| | | | |
|---|---|---|---|
| DE | 69709692 | T2 | 9/2002 |
| DE | 69730742 | T2 | 9/2005 |
| EP | 0520207 | A1 | 12/1992 |
| EP | 1167231 | A1 | 1/2002 |
| EP | 2327634 | A1 | 6/2011 |
| EP | 2774874 | A1 | 9/2014 |
| JP | 2006232323 | A | 9/2006 |
| JP | 2012158361 | A | 8/2012 |
| WO | 9851586 | A1 | 11/1998 |
| WO | 2007111667 | A2 | 10/2007 |
| WO | 2007145773 | A2 | 12/2007 |

* cited by examiner

Fig. 1
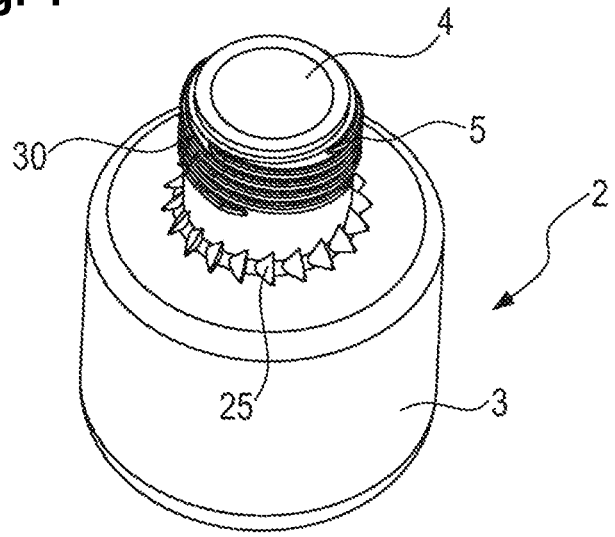
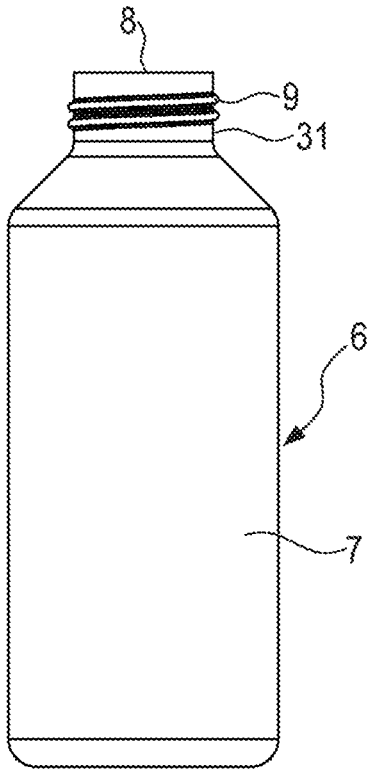
Fig. 2a
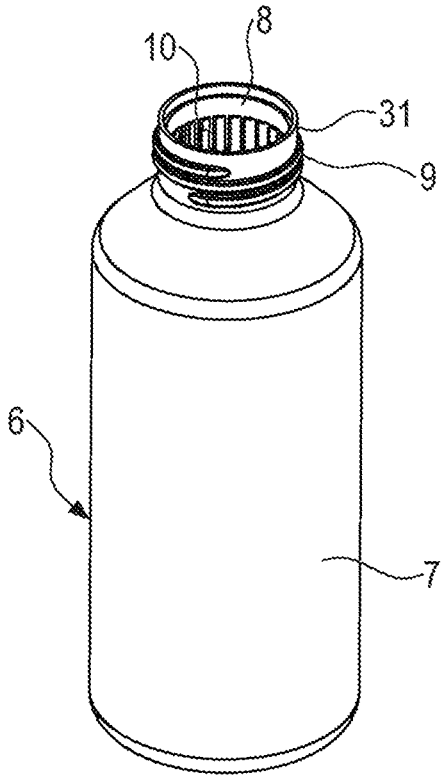
Fig. 2b

PACKAGING SYSTEM AND CORRESPONDING METHOD FOR HANDLING A PRODUCT PREPARATION COMPONENT

FIELD OF THE INVENTION

The invention relates to a packaging system for a multi-component product preparation, comprising a first container for storing a first product preparation component, a second container for storing at least one second product preparation component, and a closure element which seals off the first container from the environment and has a coupling apparatus in order to couple the second container to the closure element and in order to establish a fluid connection between the first container and the second container. Such packaging systems have generally been used for the targeted mixing of initially separately stored fluids and are primarily used when using two-component or multi-component product preparations in which the individual preparation components are incompatible with one another due to their chemical composition or are chemically highly reactive and consequently should only be mixed shortly before their actual use. Such product preparations are known from the cosmetic, medical, food and washing and cleaning agent sectors, among others.

BACKGROUND OF THE INVENTION

For example, German utility model DE 29721872 U1 describes an arrangement for coupling two containers with the aim of possible mixing of fluids initially stored separately in the containers. The coupling arrangement described therein is used, inter alia, to mix individual components of hair dyes, the individual components being incompatible with one another and therefore having to be stored separately from one another in separate containers until they are actually used. The individual components are mixed to form the ready-to-use hair dye directly before use. For this purpose, the coupling arrangement has two coupling elements, each of which allows a corresponding container to be attached. The coupling elements each form a flow passage which is in fluid connection with each container interior. In addition, the two flow passages are aligned with one another within the coupling arrangement. Furthermore, the coupling arrangement has a control element which is arranged displaceably between a first position and a second position in one of the flow passages. Depending on the position of the control element, the flow passages can be open or closed. Depending on the position of the control element, the flow passages are flowed through and thus the entire coupling arrangement is made possible or prevented. The flow passages are usually closed in the initial state of the coupling arrangement. To improve the sealing function, an additional plug is provided which closes a flow passage in the initial state of the coupling arrangement. During use, the plug is removed under the action of the displaceable control element such that the flow passages are opened to be flowed through.

WO 2007/111667 A2 describes a further system comprising two containers for separately storing two container contents, in which system the different container contents can be mixed directly before use by means of a coupling device connecting the two containers. For this purpose, the coupling device has a valve arrangement which can be moved between a closed position and an open position. In the open valve position, a flow passage which forms a fluid connection between the two containers is opened in the coupling device. Thus, when the valve is in the open position, the two container contents can be mixed.

Although the packaging systems described above allow separate storage of different substances and their mixing directly before the actual application in principle, they have an undesirably complicated structural design. In addition, such systems may also contain hazardous chemical substances which require careful and correct use. In such a case, undesired mixing of the individual substances must be prevented.

Proceeding from this, the object of the invention is that of providing an adapter-like device for coupling two containers in order to allow the fluids stored separately therein to be mixed, which device also makes simple and safe operation possible while having a structurally simple overall design and in particular prevents incorrect operation as far as possible. Furthermore, a safe method for mixing a multi-component product preparation using such a packaging system is also provided.

In principle, the term "fluids" within the meaning according to the invention is understood to mean all flowable and pourable substances, i.e. not only liquid or similarly viscous substances but also solid bulk goods such as powder or granules.

BRIEF SUMMARY OF THE INVENTION

This object is achieved by means of the subject matter of the claims. Further embodiments and advantageous designs are the subject of the dependent claims.

According to one aspect of the invention, a packaging system for a multi-component product preparation is provided which comprises a first container for storing a first product preparation component, a second container for storing at least one second product preparation component and a closure element. The closure element seals off the first container from the environment and has a coupling apparatus in order to couple the second container to the closure element and in order to establish a fluid connection between the first container and the second container. The closure element comprises a closure cap which can be separated from the closure element along a predetermined break point in order to open the fluid connection between the first container and the second container. The closure cap can be coupled to the second container so as to be blocked in a direction of rotation about an axis L of the closure element and has a thread by means of which the closure cap can be connected to the first container via a corresponding thread of the first container.

The predetermined break point is designed, for example, as a region of the closure element having a particularly small wall thickness.

The packaging system has the advantage that it can be handled particularly safely and is therefore also suitable for holding and mixing hazardous chemicals. This is achieved in particular in that the first container is initially sealed off by means of the closure cap. The closure cap can only be separated by breaking the predetermined break point when the first container is connected to the second container via the coupling apparatus of the closure cap. The fluid stored in the first container is therefore only released when it can flow into the second container. Since the closure cap is initially tightly connected to the closure element, accidentally releasing fluid from the first container is largely prevented.

This is further reinforced if the closure element, with the exception of when it has been destroyed, is non-detachably connected to the first container, for example is latched to the first container. It is then not possible to separate the closure element from the first container, for example by twisting it off, and in doing so accidentally release fluid. This greatly reduces the likelihood of operating errors.

According to one embodiment, the closure element and the second container have mutually corresponding threaded portions in order to couple the second container to the closure element by means of screwing. This is an advantageous option to securely and tightly connect the second container to the closure element and thus ultimately to the first container.

According to one embodiment, the coupling apparatus is designed as a collar having an internal thread which can be turned over a rim of an opening of the second container when the first container is coupled to the second container, wherein the internal thread interacts with an external thread of the second container in order to connect the coupling apparatus to the second container.

This embodiment has the advantage, inter alia, that a thread on the rim of the second container, which thread is also used for a closure element of the second container that is to be removed prior to mixing, can be used for the connection to the closure element. The second container can therefore be designed in a particularly simple manner.

According to an alternative embodiment, the closure cap can be connected to the second container in an interlocking manner for coupling with the second container by displacing the closure element in parallel with the axis L of the closure element.

In this embodiment, the closure element is designed to be particularly simple. For example, the closure element can be shaped such that it can be introduced into the second container. For this purpose, the second container can have a short or longer neck which tightly encloses the closure element.

Blocking the closure cap from rotating about the axis L can be achieved, for example, in that the closure cap has at least one projection which, during the coupling with the second container, interacts with at least one corresponding recess on the second container such that a rotation of the closure cap relative to the second container is blocked. In particular, a plurality of such projections and recesses can also be provided which are distributed over the circumference of the container or the closure cap. According to one embodiment, the closure cap has a large number of locking teeth in its rim region that engage in recesses on the second container that optionally form a locking ring.

According to one embodiment, the closure cap is covered from the environment by means of a cover element in such a way that manual access to the closure cap from outside is prevented.

In particular, the cover element can be designed as a sleeve-shaped portion of the closure element which radially surrounds and projects axially beyond the closure cap.

Such a cover element has the advantage that the closure cap cannot be removed manually. This represents a special safeguard which is advantageous when an aggressive substance is kept in the second container. The sleeve-shaped portion can correspond to the collar mentioned above and have a thread which corresponds to a thread on the second container.

According to one embodiment, the closure element can be coupled to the second container in a liquid-tight manner. For this purpose, said closure element in particular has at least one seal in order to ensure a liquid-tight connection to the first container and/or second container.

This embodiment has the advantage of preventing unintentional leaking of liquid before, during or after the mixing of the fluids.

According to a further aspect of the invention, a method is provided for mixing a multi-component product preparation using a packaging system comprising a first container for storing a first product preparation component, a second container for storing at least one second product preparation component, and a closure element which seals off the first container from the environment and has a coupling apparatus in order to couple the second container to the closure element and in order to establish a fluid connection between the first container and the second container, wherein the closure element comprises a closure cap which can be separated from the closure element along a predetermined break point.

The method comprises attaching the first container to the second container by means of the closure element by both corresponding threaded portions on the closure element and on the second container being attached to one another in order to be screwed together and the closure cap being coupled to the second container so as to be blocked in a direction of rotation about an axis L of the closure element.

The method further comprises screwing the closure element on the second container via the corresponding threaded portions and simultaneously separating the closure cap which is blocked in the direction of rotation from the closure element at the predetermined break point.

The method also comprises continuing to screw the closure element on the second container while simultaneously unscrewing the separated closure cap from a counter thread of the first container such that the closure cap falls into the interior of the container, and mixing the two product components in the first container and/or second container using the open fluid connection between the two containers.

The method is particularly easy to carry out even without practice. In particular, a user of the packaging system is largely prevented from coming into contact with components of the product preparation when carrying out the method.

A further aspect of the invention relates to an alternative method for mixing a multi-component product preparation using a packaging system comprising a first container for storing a first product preparation component, a second container for storing at least one second product preparation component, and a closure element which seals off the first container from the environment and has a coupling apparatus in order to couple the second container to the closure element and in order to establish a fluid connection between the first container and the second container, wherein the closure element comprises a closure cap which can be separated from the closure element along a predetermined break point.

The method comprises attaching the first container to the second container by means of the closure element by the closure cap being coupled to the second container so as to be blocked in a direction of rotation about an axis L of the closure element.

Furthermore, the method comprises rotating the closure element relative to the second container about the axis L while separating the closure cap which is blocked in the direction of rotation from the closure element at the predetermined break point.

The method further comprises detaching the separated closure cap from the first container by rotating the first container relative to the closure cap about the axis L and pressing said closure cap into an interior of the second container, and mixing the two product components in the first container and/or second container using the open fluid connection between the two containers.

BRIEF DESCRIPTION OF THE DRAWINGS

Embodiments of the invention are explained in more detail below with reference to schematic drawings.

FIG. 1 shows a perspective view of a first container of a packaging system according to a first embodiment of the invention;

FIG. 2*a* shows a first view of a second container of the packaging system according to the first embodiment of the invention;

FIG. 2*b* shows a second view of the second container of the packaging system according to the first embodiment of the invention;

DETAILED DESCRIPTION OF THE INVENTION

Figure 3A:
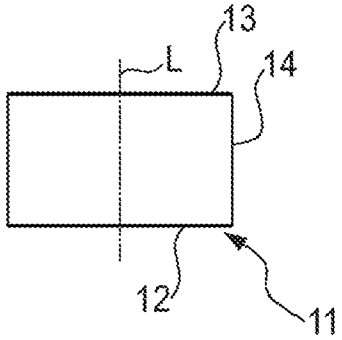
FIGS. 3*a* to 3*f* show different views of a closure element for the packaging system according to the first embodiment of the invention.

FIG. 1 shows a first container 2 which, in the embodiment shown, is designed as a glass bottle and is part of a packaging system. Alternatively, it could also be made of plastics material, for example. The packaging system can be, for example, the packaging of a hair dye which is mixed from at least two components directly before use.

The packaging system, which is explained in more detail with reference to the following figures, is used to accommodate a multi-component product preparation, with individual components being kept separately before the product is used. For this purpose, the packaging system comprises the first container 2 shown in FIG. 1, in which at least one first component of the product preparation is held. The first container 2 has a body 3 and a neck 30 which opens into an opening 4 of the container 2. A thread 5 designed as an external thread is also arranged in the region of the neck 30 as well as a locking ring 25 which is designed as a circumferential ring of locking teeth.

FIGS. 2*a* and 2*b* show side views of a second container 6 which, together with the first container 2 according to FIG. 1 and a closure element described in the following figures, represents a packaging system. The second container 6 is used to store at least one further component of the product preparation and also to mix the components from the first container 2 and the second container 6 and to store the ready-to-use product.

The second container 6 also has a body 7 and a neck 31 which opens into an opening 8. The second container 6 is typically also made of plastics material or glass.

A thread 9 designed as an external thread is also arranged in the region of the neck 31 of the second container 6. Furthermore, a locking ring 10 comprising a large number of receptacles for locking teeth is arranged on the inside of the neck 31.

In the embodiment shown, the second container 6 has a larger volume than the first container 2.

FIGS. 3*a* to 3*f* show different views of a closure element 11 which is initially used to close the first container 2 and then to connect the first container 2 to the second container 6.

FIG. 3*a* shows a side view of the closure element 11. This has a first opening 12 on one side and a second opening 13 on the opposite side. The first opening 12 is provided for connection to the opening 4 in the first container 2. The second opening 13 is provided for connection to the opening 8 in the second container 6. Furthermore, the closure element 11 has a wall 14 which has the shape of a cylinder casing. The closure element 11 has a longitudinal axis L which, in the embodiment shown, can coincide with the longitudinal axes of the containers 2, 6.

Figure 3B:
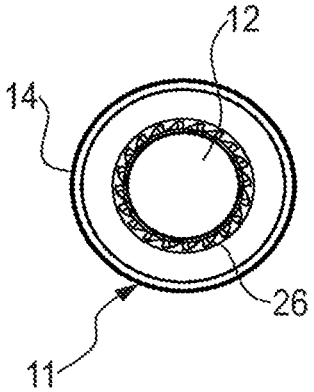
Figure 3C:
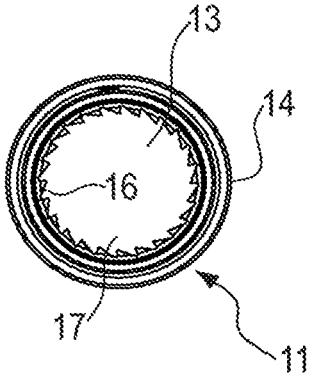
Figure 3D:
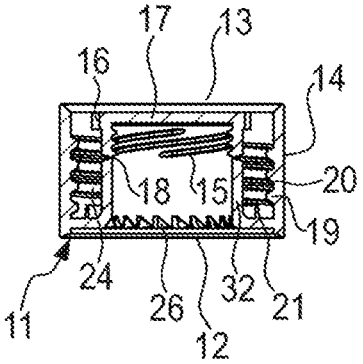
Figure 3E:
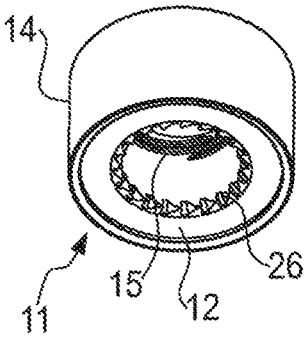

FIGS. 3*b* and 3*e* show a view of the closure element 11 from a perspective directed into the first opening 12. In particular in the perspective view according to FIG. 3*e*, it can be seen that a thread 15 designed as an internal thread is arranged inside the closure element 11. The thread 15 is designed as a thread corresponding to the thread 5 of the first container 2. The thread 5, 15 is a left-hand thread.

Figure 3F:
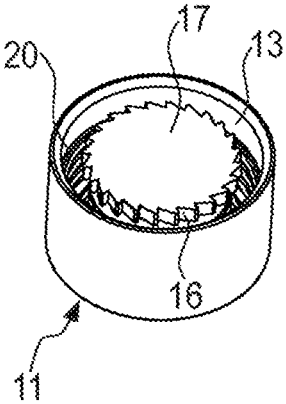

FIGS. 3*c* and 3*f* show a view of the closure element 11 in the view into the second opening 13. In this view it can be seen that the closure element 11 comprises a closure cap 17 which closes a flow path from the first opening 12 to the second opening 13. The rim of the closure cap 17 is designed as a locking ring 16 having a large number of locking teeth. The locking teeth are provided for engaging the locking ring 10 on the inside of the second container 6.

In the sectional illustration in FIG. 3*d*, it can be seen that the closure cap 17 is connected to the rest of the closure element 11 via a predetermined break point 18 which is designed as a circumferential region having a low material thickness. The thread 15 is only formed in the closure cap 17 beyond the predetermined breaking point 18.

In the sectional illustration in FIG. 3*d*, it can also be seen that the wall 14 of the closure element 11 is designed as a collar 19 which coaxially surrounds a second wall 32.

The collar-like wall 14 is used as a cover element for the closure cap 17 and has the advantage that the closure cap 17 cannot be removed manually.

The thread 15 is arranged on the inside of the second wall 32. A thread 20 which is designed as a right-hand thread is also arranged on the inside of the first wall 14. A gap 24 is formed between the first wall 14 and the second wall 32. A seal 21 is formed in this gap 24 as a circumferential sealing lip which, when in use, is intended to seal the second container 6 in a fluid-tight manner from the environment.

Figure 4A:
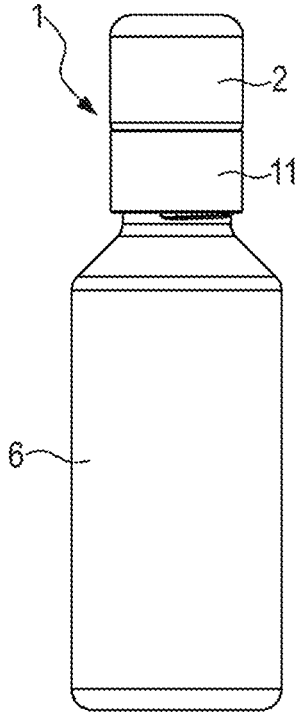
FIG. 4*a* shows a side view of the packaging system according to the first embodiment in a first position.

FIG. 4*a* shows a side view of the closure system 1 comprising the first container 2, the second container 6 and the closure element 11, which connects the first container to the second container 6, in a first position.

The closure element 11 is connected to the first container 2 via the threads 5, 15. The locking rings 25, 26 prevent the closure element 11 from being unscrewed from the first container 2 by blocking this direction of rotation. Thus, once the closure element 11 has been attached, it can only be removed again from the first container 2 by force and possibly by destroying the closure element 11.

The closure element 11 seals off the first container 2 from the environment. The first container 2 closed by the closure element 11 can therefore also be suitable for longer storage of a first component of a product preparation. In addition, the first container 2, which is permanently closed by the closure element 11, can be safely handled and is therefore also suitable for holding dangerous substances.

To mix a ready-to-use product preparation, a closure (not shown in the figures) is removed from the second container 6, in particular it is originally connected to the second container 6 via the thread 9 and is unscrewed therefrom before preparation. The first container 2 closed by the closure element 11 is then placed upside-down on the second container 6 and the closure element 11 is connected to the second container 6.

In the first embodiment shown in FIGS. 1 to 6, the closure element 11 is connected to the second container 6 by means of the thread 20 which interacts with the thread 9 of the second container 6. The closure element 11 connected to the first container 2 is thus screwed onto the second container 6.

Figure 5A:
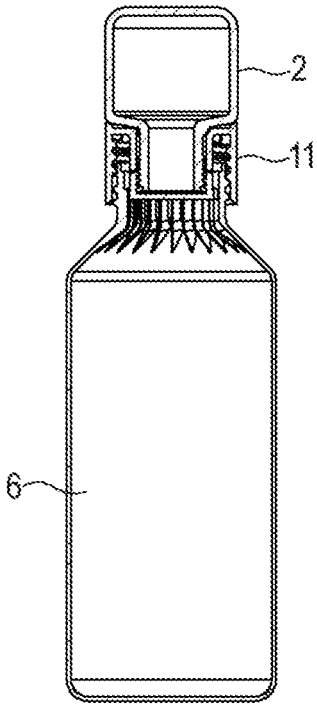
FIG. 5*a* shows a sectional view of the packaging system according to the first embodiment in a first position.

In FIG. 4*a*, the packaging system 1 is shown in a first position, specifically immediately after the first container 2 having the closure cap 11 has been placed on the second container 6 and thus at the beginning of the screwing process. As can be seen in FIG. 5*a*, at this point in time the threads 9 and 20 do not yet engage with one another. However, the collar 19 of the closure element 11 already projects over the neck 31 of the second container 6. In addition, the locking ring 16 already engages in the locking ring 10 and thus non-rotatably fixes the closure cap 17 to the second container 6.

Figure 4B:
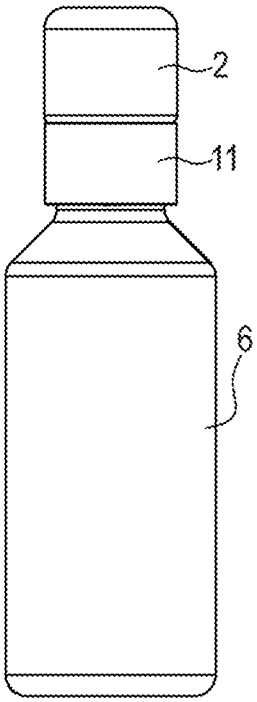
FIG. 4*b* shows a side view of the packaging system according to the first embodiment in a second position.
Figure 5B:
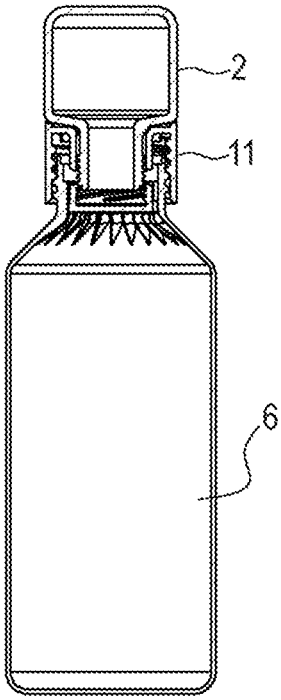
FIG. 5*b* shows a sectional view of the packaging system according to the first embodiment in a second position.
Figure 6:
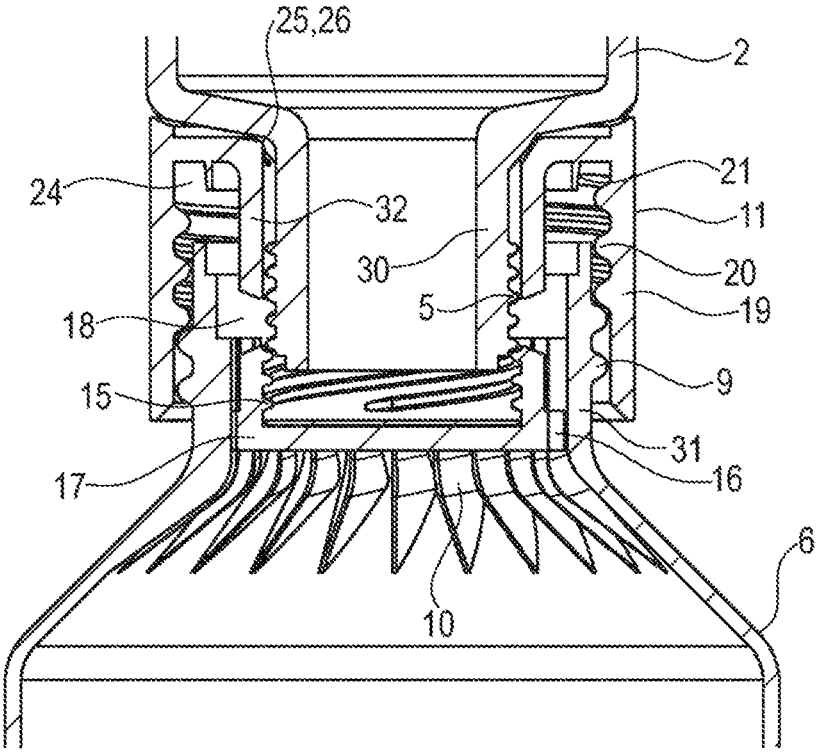
FIG. 6 shows a detail of FIG. 5*b;*

FIGS. 4*b* and 5*b* and 6 show the packaging system 1 in a second position which differs from that shown in FIGS. 4*a* and 5*a* in that the closure element 11 has already been screwed to the second container 6. As can be seen in particular in FIG. 6, the threads 9, 20 now engage with one another and the neck 31 of the second container 6 projects further into the gap 24 than in the first position according to FIG. 4*a* or 5*a*.

As can be seen in FIG. 6, by turning the closure element 11 relative to the second container 6 when screwing the closure element 11 onto the second container 6, the closure cap 17, which is fixed relative to the second container 6, has been separated from the closure element 11 along the predetermined break point 18. In the second position shown in FIGS. 4*b* and 5*b*, the closure cap 17 is still inserted in the neck 31 of the second container 6 and the locking ring 16 engages with the locking ring 10.

Figure 4C:
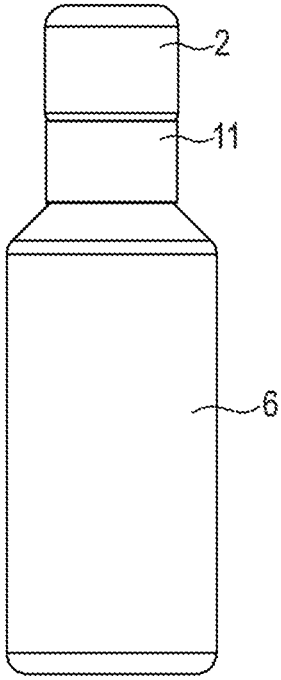
FIG. 4*c* shows a side view of the packaging system according to the first embodiment in a third position.
Figure 5C:
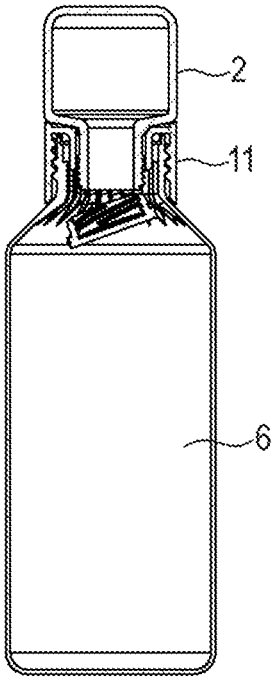
FIG. 5*c* shows a sectional view of the packaging system according to the first embodiment in a third position.

FIGS. 4*c* and 5*c* show the packaging system 1 in a third position which differs from the second position shown in FIGS. 4*b* and 5*b* in that the closure element 11 has been screwed a little further onto the second container 6. In this end position, the uppermost rim of the neck 31 of the second container 6 is in contact with the seal 21 on its inside such that the second container 6 is connected to the closure element 11 in a sealing manner.

The closure cap 17, which was already detached in the second position, has been pressed into the second container 6 by further screwing the closure element 11 onto the second container 6 and thus opened a fluid connection between the first container 2 and the second container 6. The left-hand thread 5, 15 on the closure cap 17 means that when the closure element 11 is screwed onto the second container 6, the closure cap 17 is simultaneously unscrewed from the first container 2 and falls into the second container 6.

The fluids held in the first container 2 and the second container 6 can now be mixed with one another using the fluid connection established by the separation of the closure cap 17.

The emptied first container 2 having the closure element 11 seated thereon can then be unscrewed from the second container 6 and disposed of. The finished product preparation is now available in the second container 6 for further use. If necessary, an applicator can be placed on the second container 6 for further use; in particular, it can be screwed onto the second container 6 using the thread 9.

Figure 7:
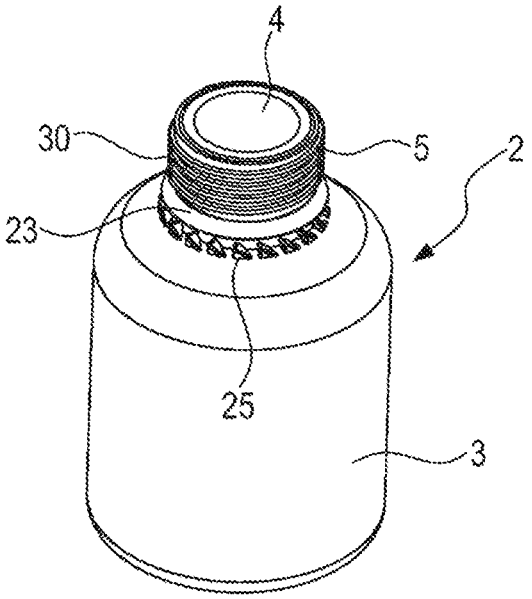
FIG. 7 shows a first container of a packaging system according to a second embodiment of the invention.

FIG. 7 shows a first container 2 for a packaging system according to a second embodiment that substantially corresponds to the first container 2 according to the first embodiment shown in FIG. 1, but additionally has a circumferential locking ring 23.

Figure 8:
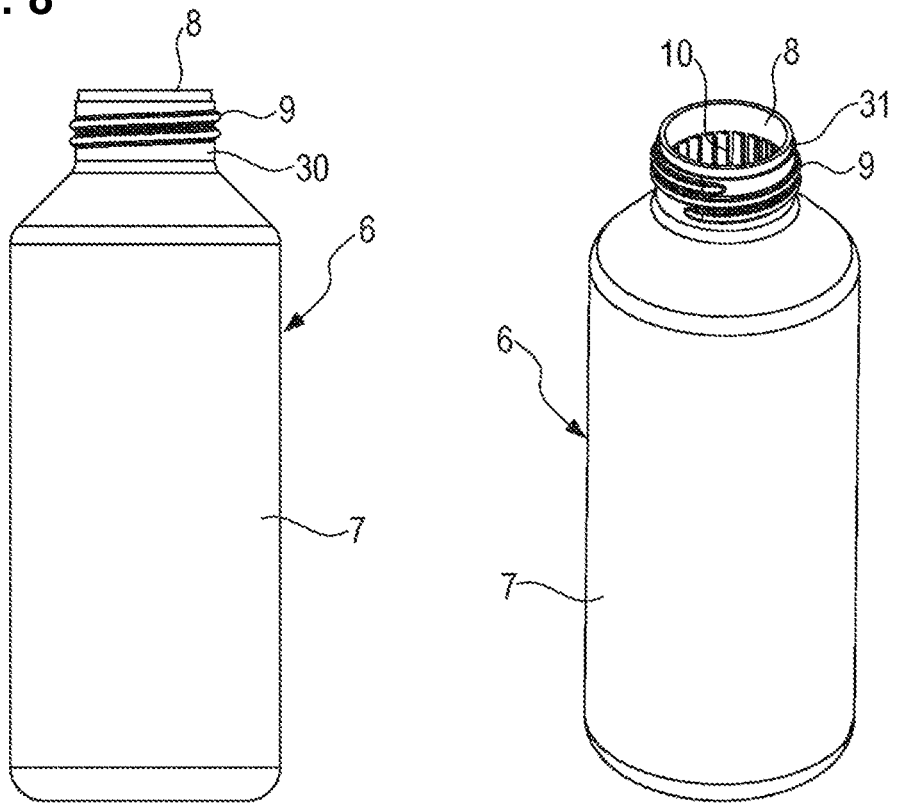
FIG. 8 shows two different views of a second container for the packaging system according to the second embodiment.

FIG. 8 shows two side views of a second container 6 according to a second embodiment of the invention, the second container 6 according to the second embodiment corresponding to the second container 6 according to the first embodiment, which has already been discussed with reference to FIGS. 2*a* and 2*b*.

FIGS. 9*a* to 9*f* show different views of a closure element 11 according to the second embodiment of the invention. This has a somewhat simpler structure than the closure element 11 according to the first embodiment and has a wall 14 having a circumferential predetermined break point 18 and a closure cap 17 having a rim region designed as a locking ring 16.

Figure 9A:
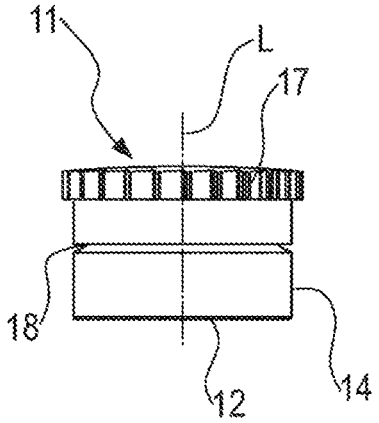
FIGS. 9*a* to 9*f* show different views of a closure element for the packaging system according to the second embodiment.
Figure 9B:
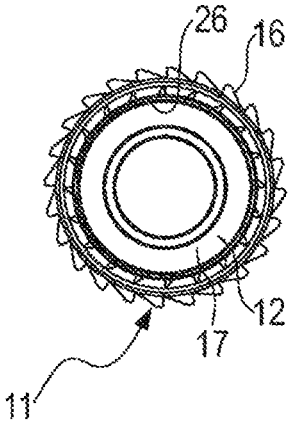
Figure 9C:
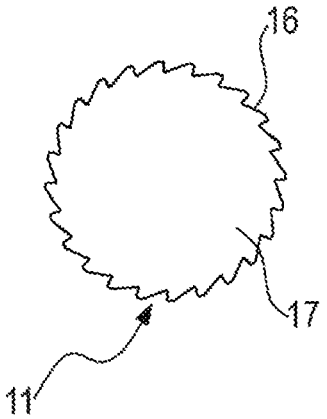
Figure 9D:
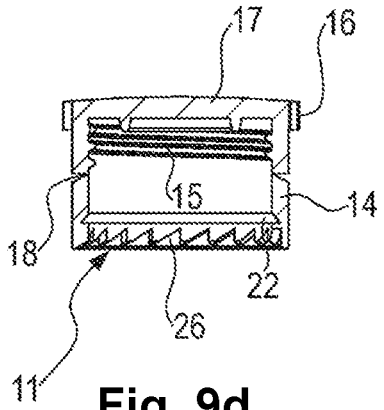
Figure 9E:
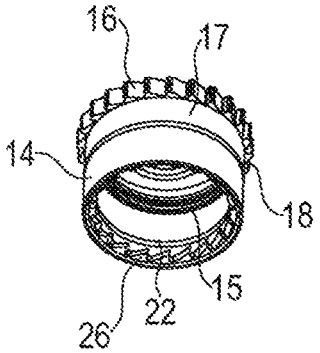
Figure 9F:
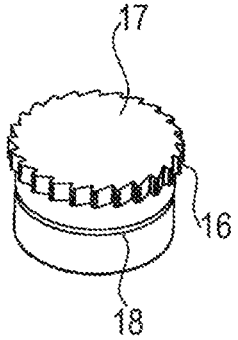

FIGS. 9*b* and 9*e* show the closure element 11 from a perspective directed into the opening 12, in which it can be seen that an inner locking ring 26 is arranged on the inside of the wall 14, which inner locking ring corresponds to the locking ring 25 of the first container 2. Furthermore, an internal thread 15, which corresponds to the thread 5 of the first container 2, is arranged in the closure cap 17, i.e. beyond the predetermined break point 18. Furthermore, a circumferential locking groove 22 is provided on the inside of the wall 14 above the inner locking ring 26, which groove corresponds to the locking ring 23 of the first container 2.

The locking ring 23 interacting with the locking groove 22 has the object of non-detachably connecting the closure element 11 to the first container 2 in order to prevent accidental opening of the first container 2, which may contain a dangerous substance.

Figure 10A:
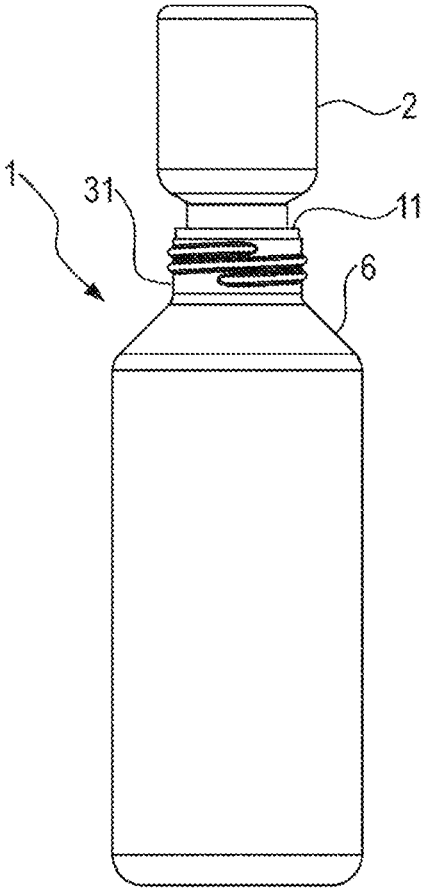
FIG. 10*a* shows a side view of the packaging system according to the second embodiment in a first position.
Figures 11A, 11B, 11C:
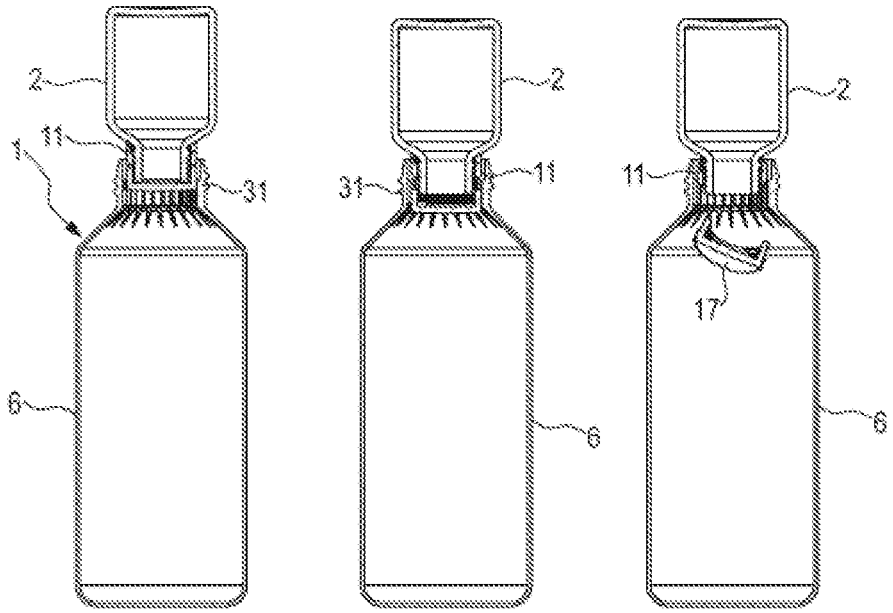
FIG. 11*a* shows a sectional view of the packaging system according to the second embodiment in a first position.
FIG. 11*b* shows a sectional view of the packaging system according to the second embodiment in a second position.
FIG. 11*c* shows a sectional view of the packaging system according to the second embodiment in a third position.

FIGS. 10*a* and 11*a* show a side view and a sectional view of the packaging system 1 comprising the first container 2 which is connected to the second container 6 by means of the closure element 11 in a first position. In this position, the first container provided with the closure element 11 has been inserted into the neck 31 of the second container 6 and the locking ring 16 of the closure cap 17 has been brought into engagement with the locking ring 10 of the second container 6. As a result, the closure cap 17 has been non-rotatably fixed to the second container 6.

The first container 6 is then pushed into the neck 31 of the second container 6 until the first container 2 contacts the neck 31 of the second container 6.

Figure 10B:
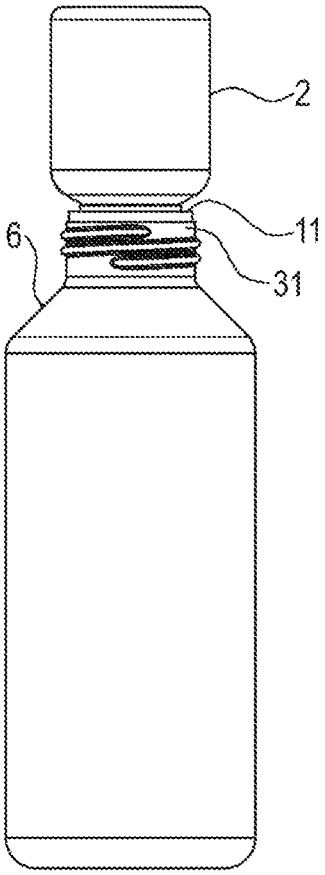
FIG. 10*b* shows a side view of the packaging system according to the second embodiment in a second position.

FIGS. 10*b* and 11*b* show the packaging system 1 in a second position. In this, the first container 2 provided with the closure element 11 has been rotated relative to the second container 6. As a result, the closure cap 17, which is non-rotatably fixed on the second container 6, has been separated from the rest of the closure element 11 at the predetermined break point 18. In order to separate the closure cap 17, the first container 2 is pulled upward slightly in order to ensure that the locking ring 16 remains in engagement with the locking ring 10, and is then rotated counterclockwise.

Figure 12:
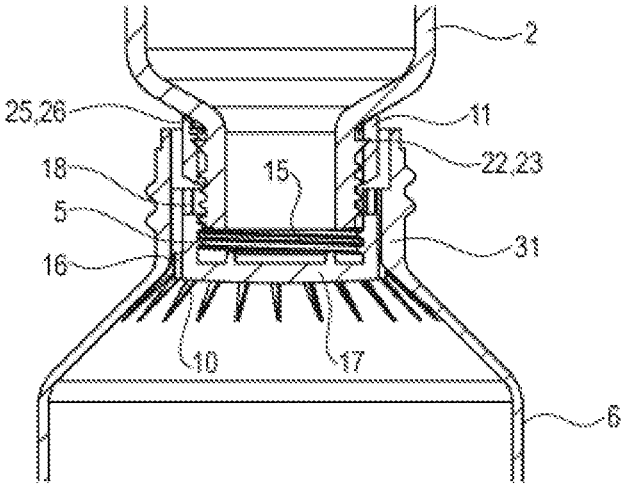
FIG. 12 shows a detail of FIG. 11*b*.

FIG. 12 shows this position in detail.

In order to unscrew the already-separated closure cap 17 from the first container 2, it is further rotated counterclockwise. The closure cap 17 is thereby unscrewed from the thread 5 of the first container 6 and, as shown in FIG. 11*c*, falls into the second container 6.

The product preparation components can then be mixed using the fluid connection that has now been produced between the containers 2, 6.

REFERENCE NUMERALS

1 packaging system
2 first container
3 body
4 opening
5 thread
6 second container
7 body
8 opening
9 thread
10 locking ring
11 closure element
12 first opening
13 second opening
14 wall
15 thread
16 locking ring
17 closure cap
18 predetermined break point
19 collar
20 thread
21 seal
22 latching groove
23 latching ring
24 gap
25 locking ring
26 inner locking ring
30 neck
31 neck
32 wall
L axis

What is claimed is:

1. A packaging system for a multi-component product preparation, comprising a first container for storing a first product preparation component, a second container for storing at least one second product preparation component, and a closure element which seals off the first container from the environment and has a coupling apparatus in order to couple the second container to the closure element and in order to establish a fluid connection between the first container and the second container, wherein the closure element comprises a closure cap which can be separated from the closure element along a predetermined break point in order to open the fluid connection between the first container and the second container, wherein the closure cap can be coupled to the second container so as to be blocked in a direction of rotation about an axis of the closure element and has a thread by means of which the closure cap can be connected to the first container via a corresponding thread of the first container.

2. The packaging system according to claim 1, wherein the closure element, with the exception of when it has been destroyed, is non-detachably connected to the first container.

3. The packaging system according to claim 2, wherein the closure element is non-detachably latched to the first container.

4. The packaging system according to claim 1, wherein the closure element and the second container have mutually corresponding threaded portions in order to couple the second container to the closure element by means of screwing.

5. The packaging system according to claim 4, wherein the coupling apparatus is designed as a collar having an internal thread which can be turned over a rim of an opening of the second container when the first container is coupled to the second container, wherein the internal thread interacts with an external thread of the second container in order to connect the coupling apparatus to the second container.

6. The packaging system according to claim 1, wherein the closure cap can be connected to the second container n an interlocking manner for coupling with the second container by displacing the closure element in parallel with the axis of the closure element.

7. The packaging system according to claim 1, wherein the closure cap has at least one projection which, during the coupling with the second container, interacts with at least one corresponding recess on the second container such that a rotation of the closure cap relative to the second container is blocked.

8. The packaging system according to claim 1, wherein the closure cap is covered from the environment by means of a cover element in such a way that manual access to the closure cap from outside is prevented.

9. The packaging system according to claim 8, wherein the cover element is designed as a sleeve-shaped portion of the closure element which radially surrounds and projects axially beyond the closure cap.

10. The packaging system according to claim 1, wherein the closure element can be coupled to the second container in a liquid-tight manner.

11. The packaging system according to claim 1, wherein the closure element has at least one seal in order to ensure a liquid-tight connection to the first and/or second container.

12. A method for mixing a multi-component product preparation using a packaging system comprising a first container for storing a first product preparation component, a second container for storing at least one second product preparation component, and a closure element which seals off the first container from the environment and has a coupling apparatus in order to couple the second container to the closure element and in order to establish a fluid connection between the first container and the second container, wherein the closure element comprises a closure cap which can be separated from the closure element along a predetermined break point, wherein the method comprises the following steps:

attaching the first container to the second container by means of the closure element by both corresponding threaded portions on the closure element and on the second container being attached to one another in order to be screwed together and the closure cap being coupled to the second container so as to be blocked in a direction of rotation about an axis of the closure element, screwing the closure element on the second container via the corresponding threaded portions and simultaneously separating the closure cap which is blocked in the direction of rotation from the closure element at the predetermined break point, continuing to screw the closure element on the second container while simultaneously unscrewing the separated closure cap from a counter thread of the first container such that the closure cap falls into the interior of the container, mixing the two product components in the first container and/or second container using the open fluid connection between the two containers.

13. A method for mixing a multi-component product preparation using a packaging system comprising a first container for storing a first product preparation component, a second container for storing at least one second product preparation component, and a closure element which seals off the first container from the environment and has a coupling apparatus in order to couple the second container to the closure element and in order to establish a fluid connection between the first container and the second container, wherein the closure element comprises a closure cap which can be separated from the closure element along a predetermined break point, wherein the method comprises the following steps:

attaching the first container to the second container by means of the closure element by the closure cap being coupled to the second container so as to be blocked in a direction of rotation about an axis of the closure element, rotating the closure element relative to the second container about the axis while separating the closure cap which is blocked in the direction of rotation from the closure element at the predetermined break point, the separated closure cap being detached from the first container by rotating the first container relative to the closure cap about the axis and being pressed into an interior of the second container, mixing the two product components in the first container and/or second container using the open fluid connection between the two containers.

* * * * *